US007731610B2

(12) United States Patent
Im

(10) Patent No.: US 7,731,610 B2
(45) Date of Patent: Jun. 8, 2010

(54) MULTIPURPOSE PREFABRICATED SPORTING GOODS

(76) Inventor: Jeong-Hun Im, 71-1 Sin-ri, Jeongnam-myeon, B-202, Hanyang-Villa, Hwaseong-si, Gyeonggi-do (KR) 445-961

( * ) Notice: Subject to any disclaimer, the term of this patent is extended or adjusted under 35 U.S.C. 154(b) by 134 days.

(21) Appl. No.: 12/095,181

(22) PCT Filed: Nov. 28, 2006

(86) PCT No.: PCT/KR2006/005039

§ 371 (c)(1),
(2), (4) Date: May 28, 2008

(87) PCT Pub. No.: WO2007/061270

PCT Pub. Date: May 31, 2007

(65) Prior Publication Data

US 2008/0293519 A1 Nov. 27, 2008

(30) Foreign Application Priority Data

Nov. 28, 2005 (KR) ..... 20-2005-0033496 U

(51) Int. Cl.
*A63B 61/00* (2006.01)
*A63B 63/00* (2006.01)
*A63B 63/08* (2006.01)

(52) U.S. Cl. ..... 473/476; 473/479; 473/483; 473/478

(58) Field of Classification Search ..... 473/476, 473/478, 479, 483; 273/398, 407, 400–402
See application file for complete search history.

(56) References Cited

U.S. PATENT DOCUMENTS 4,762,319 A * 8/1988 Krumholz ..... 473/416
4,786,053 A * 11/1988 Barnes, Jr. ..... 473/416
5,249,796 A * 10/1993 Silvi ..... 473/416
5,564,711 A * 10/1996 Scheie ..... 273/400

(Continued)

FOREIGN PATENT DOCUMENTS

KR 20-1991-0019722 12/1991

(Continued)

*Primary Examiner*—Raleigh W. Chiu
(74) *Attorney, Agent, or Firm*—IPLA P.A.; James E. Bame

(57) ABSTRACT

Disclosed is a multi-purpose sectional sports apparatus. The sports apparatus includes a plurality of assembling poles each including a main pole and a sub pole, a connector, and a supporting unit. The main pole has an insertion bore, an L-shaped lower fixture and a plurality of main coupling holes in an upper portion thereof. The sub pole is inserted into the main pole and has a plurality of lower height-adjusting holes and a plurality of upper sub coupling holes. The sub pole is movable up and down to have an adjustable height relative to the main pole as a fastener is fastened through selected ones of the height-adjusting holes and main coupling holes. The connector includes a branched body having a plurality of insertion branches for connection of the assembling poles, each insertion branch having an opening and an insertion bore. The supporting unit includes a plurality of supporting bars for supporting the assembling poles, at least one hollow supporting-connection member having a plurality of supporting-insertion branches for insertion of, for example, the supporting bars, and at least one branched connection member having a plurality of supporting-insertion branches for insertion of, for example, the supporting bars.

1 Claim, 3 Drawing Sheets

U.S. PATENT DOCUMENTS

| | | | | |
|---|---|---|---|---|
| 5,857,928 | A * | 1/1999 | Stewart | 473/446 |
| 5,865,691 | A * | 2/1999 | Chen | 473/416 |
| 7,351,168 | B1 * | 4/2008 | Pannell | 473/476 |
| 2004/0127309 | A1 * | 7/2004 | Huang | 473/476 |
| 2005/0062231 | A1 * | 3/2005 | Oister et al. | 273/407 |
| 2007/0191150 | A1 * | 8/2007 | Lu | 473/479 |
| 2008/0293519 | A1 * | 11/2008 | Im | 473/421 |

FOREIGN PATENT DOCUMENTS

| | | |
|---|---|---|
| KR | 20-1996-0016406 | 6/1996 |
| KR | 20-1998-0065196 | 11/1998 |
| KR | 20-0247742 | 9/2001 |

* cited by examiner

[Fig. 1]
Prior Art
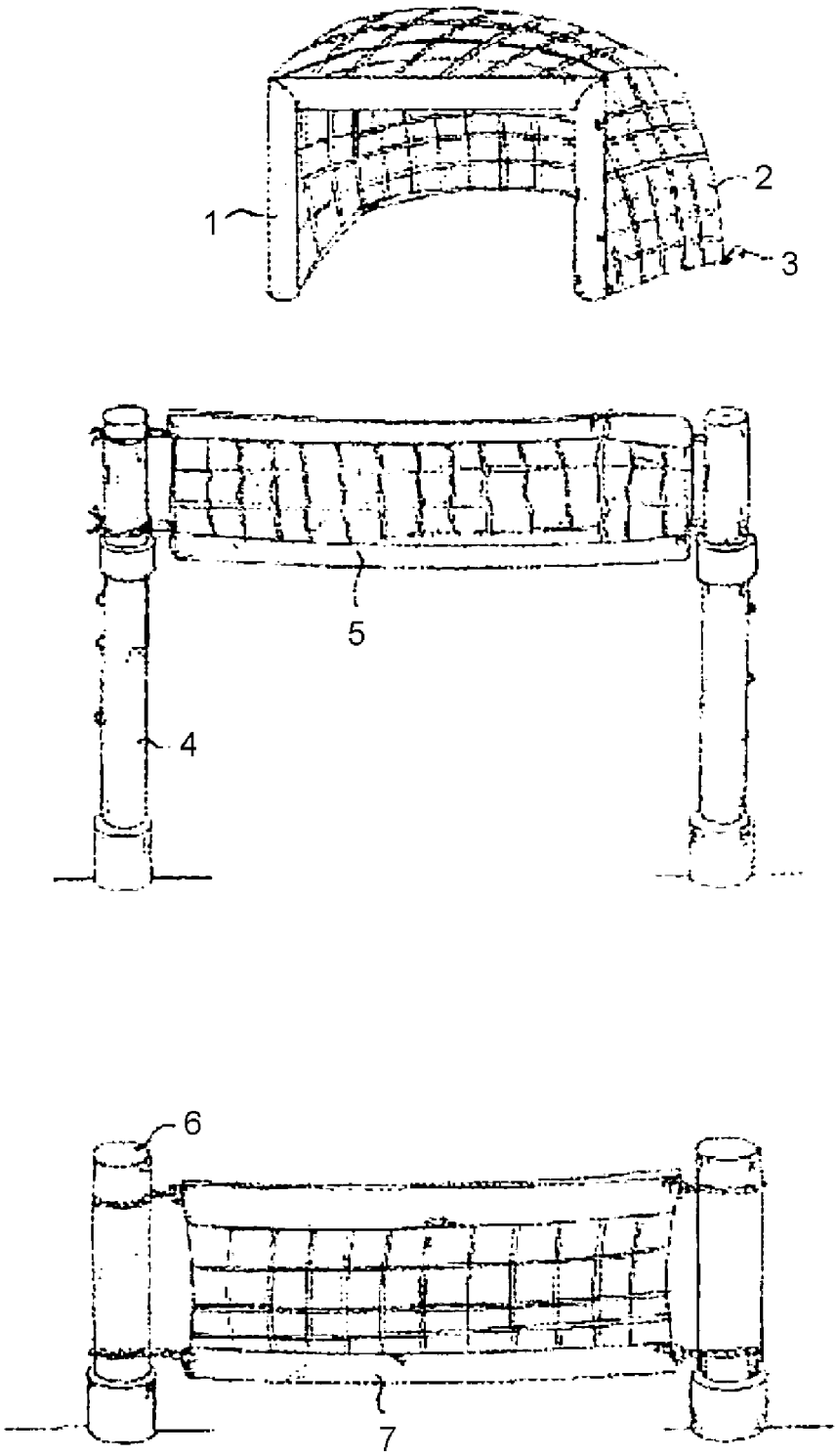

[Fig. 2]
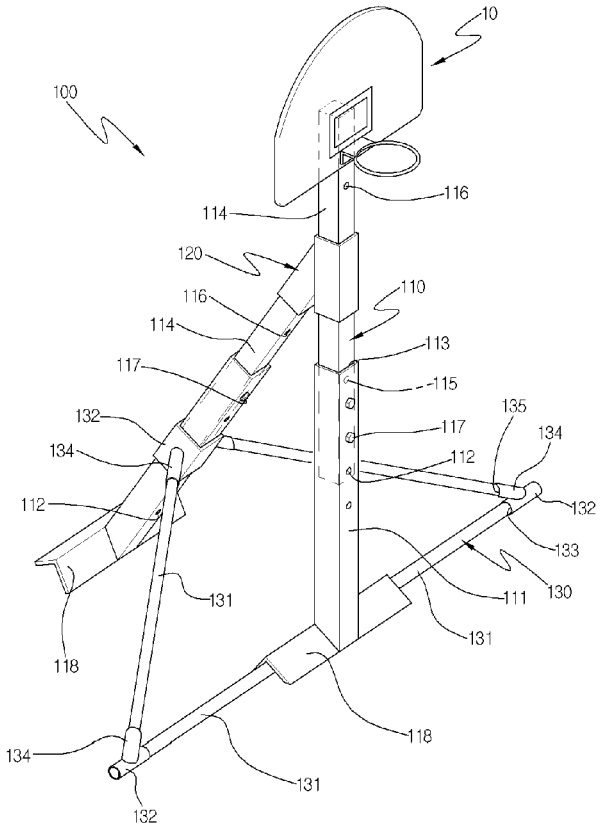
[Fig. 3]
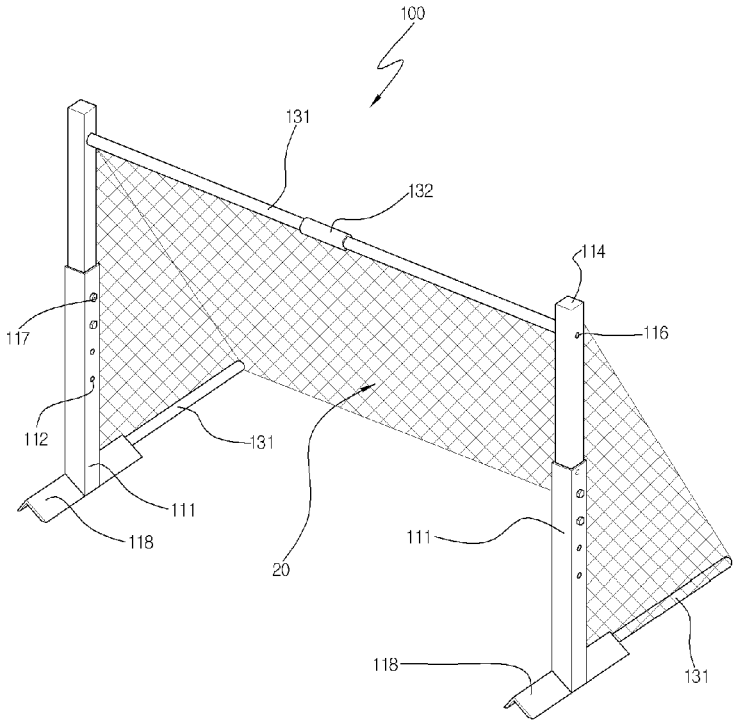

[Fig. 4]
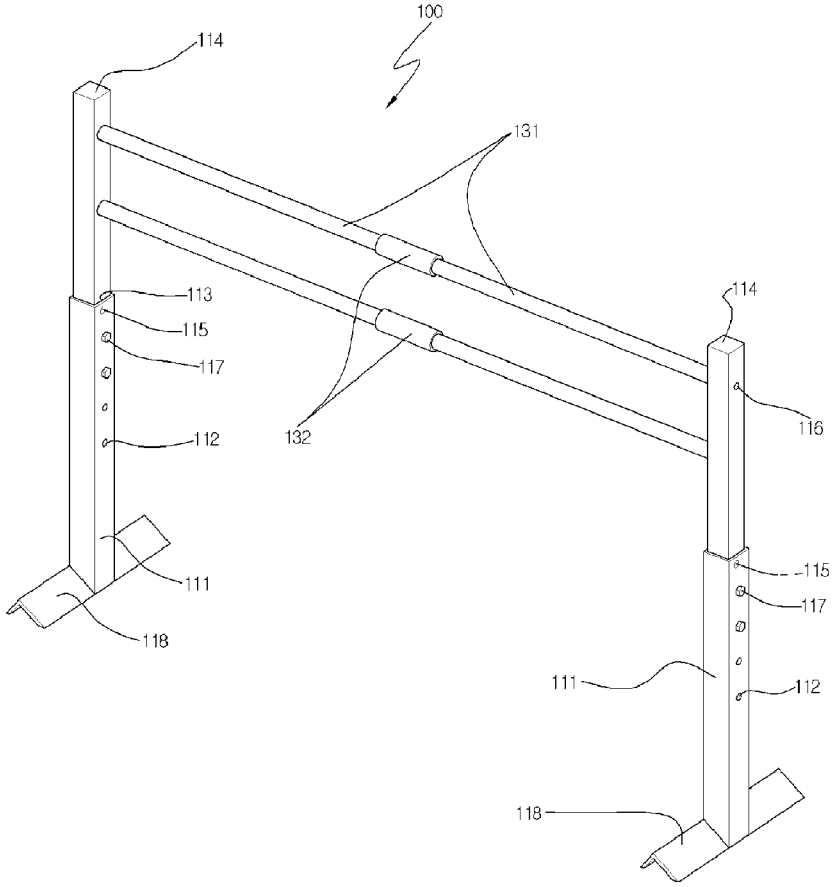
[Fig. 5]
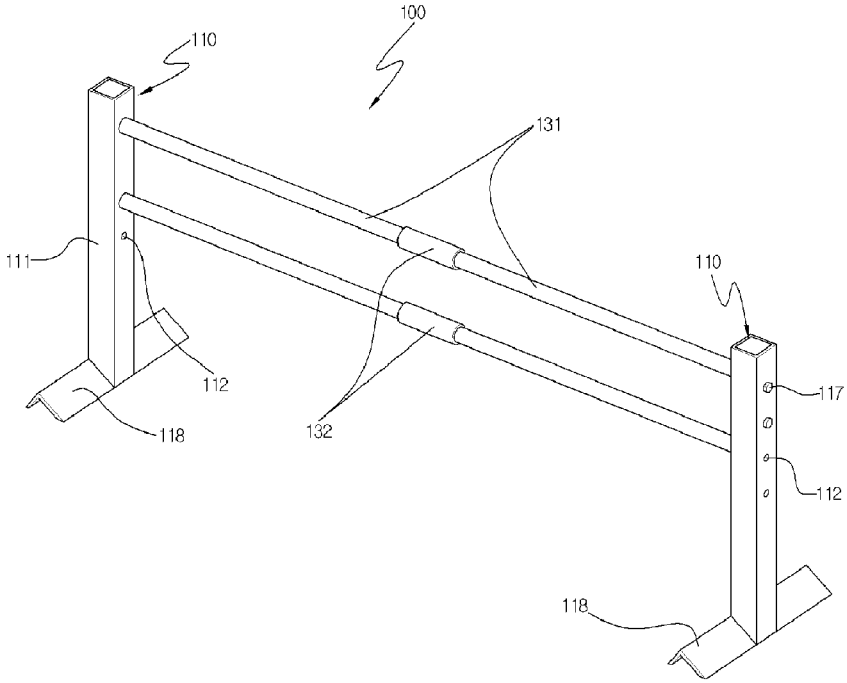

MULTIPURPOSE PREFABRICATED SPORTING GOODS

TECHNICAL FIELD

The present invention relates to a multipurpose sectional sports apparatus, and more particularly, to a multipurpose sectional sports apparatus in which a plurality of height-adjustable assembling poles are connected to one another and supported by at least one connector and a supporting unit, to assemble a variety of transformable sports structures that are usable in a variety of ball games, whereby the multi-purpose sectional sports apparatus can be easily transformed without using additional equipment so as to be universally used in a variety of sports, and achieve many advantages of convenience in assembling/disassembling operations, high economical efficiency as well as carrying/storage efficiency of the sports apparatus.

BACKGROUND ART

Generally, sports apparatuses used for ball games are constructed, on the basis of the kinds of the ball games, by joining various shapes of iron pipes via a welding process, etc. For example, volleyball uses a net structure constructed by hanging a net between a pair of elongated poles mounted at left and right borders of a volleyball court, soccer uses a rectangular goalpost, tennis or Jokgu has a lower net height than that of volleyball, badminton has a different pole distance from that of volleyball, and basketball uses an apparatus consisting of a net basket, a bounding backboard, and a triangular supporting base. As described above, these various ball games have a need for a variety of apparatuses having different shapes from one another.

FIG. 1 illustrates a variety of sports apparatuses used for different ball games.

As shown in FIG. 1, each of a variety of sports apparatuses used for different ball games includes a supporting member 1, 4, or 6 and a net 2, 5, or 7, and is fixedly or movably installed on a sports court. Each of the sports apparatuses is designed to be exclusively used in only an associated sports game.

The above described conventional sports apparatuses for exclusive use in associated sports games have several problems as follows.

Firstly, the conventional sports apparatuses are constructed by welding iron pipes or angled members, which are prepared to have different lengths and straight or bent shapes required to obtain characteristic shapes of the sports apparatuses, and thus, have a difficulty in their mass production. Also, the conventional sports apparatuses have a limit in the number of workers allowed to participate in the manufacture of each product and therefore, suffer from increased labor costs and consequently, enormous manufacturing costs and time.

Secondly, the conventional sports apparatuses for exclusive use in associated ball games have completely different structures from one another and cannot be used compatibly in other ball games. Accordingly, a plurality of different sports apparatuses should be provided to enjoy a variety of ball games, and this causes problems of increased purchase costs and insufficient installation space for the plurality of sports apparatuses.

Thirdly, the conventional sports apparatuses, which are constructed by welding iron pipes to have their characteristic shapes, have no transformation ability and consequently, have no compatibility. Accordingly, it is essential to prepare a plurality of different sports apparatuses for exclusive use in a variety of ball games, and this inevitably causes a need for a large-scale storage space as well as increased storage costs.

Fourthly, the conventional sports apparatuses have to be transported while maintaining their basic shapes in spite of the fact that they have a large size and heavy weight. Therefore, the conventional sports apparatuses have a problem of enormous transportation costs.

Fifthly, preparing all the conventional sports apparatuses for use in a variety of ball games that have different shapes from one another makes it difficult to construct a physical sports complex facility due to a limit in efficient use of a space.

DISCLOSURE OF INVENTION

Technical Problem

Therefore, the present invention has been made to solve the above problems, and it is an object of the present invention to provide a multipurpose sectional sports apparatus in which a plurality of height-adjustable assembling poles are separably and stably assembled, in a simplified manner, with one another by use of at least one connector and a supporting unit, to construct a variety of transformable sports apparatuses, whereby the multipurpose sectional sports apparatus can be used compatibly in a variety of ball games.

Technical Solution

In accordance with the present invention, the above and other objects can be accomplished by the provision of a multipurpose sectional sports apparatus comprising: a plurality of assembling poles each including a main pole and a sub pole, wherein the main pole has a center insertion bore, an L-shaped lower fixture formed at a lower end of the main pole for supporting the main pole and a plurality of main coupling holes perforated in an upper portion of the main pole so as to be vertically arranged in a line with a regular distance, the sub pole is configured to be inserted into the insertion bore of the main pole and has a plurality of height-adjusting holes perforated in a lower portion of the sub pole and a plurality of sub coupling holes perforated in an upper portion of the sub pole, and the sub pole is movable up and down to adjust a height relative to the main pole as a fastener is fastened through a selected one of the height-adjusting holes of the sub pole and a corresponding one of the main coupling holes of the main pole; at least one connector including a branched body having a plurality of insertion branches radially protruding from the body with certain angles therebetween for connection of the plurality of assembling poles, each insertion branch having an opening serving as an entrance/exit of a corresponding one of the assembling poles and an insertion bore for receiving the assembling pole; and a supporting unit including a plurality of supporting bars for supporting the plurality of assembling poles when the assembling poles are connected to one another by the connector, at least one hollow supporting-connection member having a plurality of supporting-insertion branches for insertion of, for example, supporting bars, the assembling pole or supporting bars selectively penetrating through the hollow supporting-connection member, and at least one branched connection member having a plurality of supporting-insertion branches for insertion of, for example, supporting bars.

Advantageous Effects

With a multipurpose sectional sports apparatus according to the present invention which comprises: a plurality of assembling poles each including a pipe-shaped main pole and a sub pole, the main pole having a center insertion bore, an L-shaped lower fixture formed at a lower end of the main pole for balancing the main pole and a plurality of main coupling holes perforated in an upper portion of the main pole with a regular distance, the sub pole being configured to be inserted into the insertion bore of the main pole and having a plurality of height-adjusting holes perforated in a lower portion of the sub pole and a plurality of sub coupling holes perforated in an upper portion of the sub pole, the sub pole being movable up and down to have an adjustable height relative to the main pole as a fastener is fastened through a selected one of the height-adjusting holes of the sub pole and a corresponding one of the main coupling holes of the main pole; at least one connector including a branched body having a plurality of insertion branches radially protruding from the body with certain angles therebetween for connection of the plurality of assembling poles, each insertion branch having an opening serving as an entrance/exit of a corresponding one of the assembling poles and an insertion bore for receiving the assembling pole; and a supporting unit for supporting the assembling poles. With this configuration, the assembling poles can be assembled, in a simplified manner, with one another by the connector, to construct a variety of sports structures for use in a variety of ball games. By assembling the height-adjustable assembling poles by the connector that has the plurality of pole insertion branches radially protruded from the connector body by a variety of angles, the multipurpose sectional sports apparatus of the present invention can be used compatibly to construct a desired one of various shapes of sports apparatuses.

The multipurpose sectional sports apparatus according to the present invention, in which the height-adjustable assembling poles are connected to one another by the connector to construct a desired one of a variety of sports structures while being stably supported by a plurality of supporting bars, is efficient for mass production, resulting in a reduction in the manufacturing costs of the sports structure.

Further, in the multipurpose sectional sports apparatus according to the present invention, the sub pole is movable up and down in the main pole to adjust a height relative to the main pole as a fastener is fastened through selected holes of both the poles. Accordingly, the overall height of the assembling pole according to the present invention can be simply adjusted. To the assembling bars can be coupled appropriately prepared supporting bars in consideration of the shape of a desired sports structure to be constructed. According to the present invention, since the resulting sports structure can be easily disassembled into respective unit pieces of, for example, iron pipes, connecting members, and supporting members, the multipurpose sectional sports apparatus of the present invention can achieve advantages of convenient carrying/storage as well as a reduced storage space.

Furthermore, the multipurpose sectional sports apparatus of the present invention can be assembled into a variety of sports structures. Accordingly, it is possible to enjoy a variety of sports games with a single sports apparatus in a small space, and this results in efficient use of a space.

Finally, the multipurpose sectional sports apparatus according to the present invention can be installed in a physical sports complex facility such as a public park, to allow people to conveniently enjoy a variety of sports games, resulting in an improvement in the health of people, at a low price.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a configuration view of conventional sports apparatuses;

FIG. 2 is a perspective view illustrating a multipurpose sectional sports apparatus according to an embodiment of the present invention, which is assembled to construct a basketball basket structure;

FIG. 3 is a perspective view illustrating a multipurpose sectional sports apparatus according to another embodiment of the present invention, which is assembled to construct a soccer goalpost;

FIG. 4 is a perspective view illustrating a multipurpose sectional sports apparatus according to a further embodiment of the present invention, which is assembled to construct a volleyball net structure; and FIG. 5 is a perspective view illustrating a multipurpose sectional sports apparatus according to yet another embodiment of the present invention, which is assembled to construct a Jokgu net structure.

BEST MODE FOR CARRYING OUT THE INVENTION

Now, preferred embodiments of a multipurpose sectional sports apparatus according to the present invention will be described with reference to the accompanying drawings.

FIGS. 2 to 5 are perspective views illustrating a multipurpose sectional sports apparatus according to preferred embodiments of the present invention, FIG. 2 illustrating a basketball basket structure, FIG. 3 illustrating a soccer goalpost, FIG. 4 illustrating a volleyball net structure, and FIG. 5 illustrating a Jokgu net structure.

As shown in FIGS. 2 to 5, the multipurpose sectional sports apparatus of the present invention includes a plurality of height-adjustable assembling poles 110, at least one connector 120 configured to connect the plurality of assembling poles 110 to one another, and a supporting unit 130 configured to support the assembling poles 110.

Each of the assembling poles 110 includes a main pole 111 having a center insertion bore 113, an L-shaped lower fixture 118 provided at a lower end of the main pole 111 for supporting the main pole 111, and a plurality of main coupling holes 112 perforated in an upper portion of the main pole 111. The main coupling holes 112 are vertically arranged in a line with a regular distance. The assembling pole 110 further includes a sub pole 114 configured to be inserted into the insertion bore 113 of the main pole 111. The sub pole 114 has a plurality of height-adjusting holes 115 perforated in a lower portion of the sub pole 114 so as to be vertically arranged in a line with a regular distance. With this configuration, the sub pole 114 is movable up and down to adjust a height relative to the main pole 111 as a fastener 117 is fastened through a selected one of the height-adjusting holes 115 of the sub pole 114 and a corresponding one of the main coupling holes 112 of the main pole 111. The sub pole 114 also has a plurality of sub coupling holes 116 perforated in an upper portion of the sub pole 114 so as to be vertically arranged in a line with a regular distance.

The connector 120 includes a branched body 123 having a plurality of insertion branches 124 radially protruding from the body 123 with certain angles therebetween for connection of the plurality of assembling poles 110. Each of the insertion branches 124 has an opening 121 serving as an entrance/exit of the assembling pole 110 and an insertion space 122 defined in the insertion branch 124 for receiving the assembling pole 110.

The supporting unit 130 includes a plurality of supporting bars 131 for supporting the plurality of assembling poles 110 when the assembling poles 110 are connected to one another by the connector, at least one supporting-connection member 132 having a plurality of supporting-insertion branches 133 for insertion of, for example, the supporting bars 131, the supporting-connection member 132 having a hollow structure to allow the assembling pole 110 to penetrate through the supporting-connection member 132, and at least one branched connection member 134 having a plurality of supporting-insertion branches 135 for insertion of, for example, the supporting bars 131.

Now, the operation of the multipurpose sectional sports apparatus having the above described configuration according to the present invention will be described.

In an embodiment of the present invention in which the multipurpose sectional sports apparatus 100 is assembled to construct a basketball basket structure having a basket unit 10 as shown in FIG. 2, the main pole 111 having the L-shaped lower fixture 118 is first erected on a desired position and then, the sub pole 114 is inserted into the insertion bore 113 of the main pole 111 such that the sub pole 114 can be secured at a desired height relative to the main pole 111 as the fastener 117 is fastened through aligned selected ones of the plurality of height-adjusting holes 115 of the sub pole 114 and the plurality of main coupling holes 112 of the main pole 111. If one assembling pole 110 is completely assembled as in the described manner, subsequently, a second assembling pole 110 is assembled similarly.

In a state wherein the first assembling pole 110 is erected at the desired position where the basketball basket structure is to be installed, the second assembling pole 110 is diagonally connected to a rear portion of the first assembling pole 110 by the connector 120. For this, if the first assembling pole 110 is inserted into the insertion bore 122 of a selected one of the insertion branches of the branched body 123, the second assembling pole 110 having an appropriately adjusted length is inserted into the insertion bore 122 of another insertion branch 124 that is branched rearward relative to the selected insertion branch 124, so as to support the rear portion of the first assembling pole 110.

After the vertically-erected first assembling pole 110 is connected to the diagonally-installed second assembling pole 110 by use of the connector 120 so as to be supported at the rear portion thereof by the second assembling pole 110, both the assembling poles 110 are more stably supported by the supporting unit 130. For this, in the present embodiment, the supporting-connection member 132 having the supporting-insertion branches 133 is inserted into the diagonally-installed assembling pole 110. Subsequently, two supporting bars 131 are assembled to opposite sides of the lower end of the vertically-erected assembling pole 110, and two supporting bars 131 are fitted into the supporting-insertion branches 133 of the supporting-connection member 132. Facing ends of the four supporting bars 131 are coupled to one another by two branched connection members 134. With the arrangement of the supporting bars 131, the lower end of the vertically-erected assembling pole 110 and opposite lateral portions of the diagonally-installed assembling pole 110 can be stably supported.

Finally, in a state wherein the vertically-erected assembling pole 110 is connected to the diagonally-installed assembling pole 110 by the connector 120 such that both the assembling poles 110 are supported by the supporting bars 131, a basketball basket unit 10 is coupled to an upper end of the vertically-erected assembling pole 110 as a fastener is fastened through a selected one of the plurality of sub coupling holes 116 formed at the upper portion of the assembling pole 110 and the basket unit 10.

Referring to FIG. 3 illustrating another embodiment of the present invention in which the multipurpose sectional sports apparatus is assembled to construct a soccer goalpost, two assembling poles 110 are first arranged with a predetermined distance. Then, two supporting bars 131 are connected to each other by the supporting-connection member 132 to have the same length as the distance of the two assembling poles 110. If the connected supporting bars 131 are assembled to both the assembling poles 110 as fasteners are fastened through selected ones of the sub coupling holes 116 formed at the upper portion of the two assembling poles 110, a net 20 is coupled to a rear side of the resulting structure to construct a soccer goalpost.

Referring to FIG. 4 illustrating a further embodiment of the present invention in which the multipurpose sectional sports apparatus is assembled to construct a volleyball net structure, two assembling poles 110, which have an appropriately adjusted height corresponding to the standard height of a volleyball net, are positioned at opposite sides of a volleyball court along a center line of the volleyball court. Then, two supporting bar structures, each being obtained by connecting two supporting bars 131 by the supporting-connection member 132, are assembled to selected ones of the sub coupling holes 116 of the two assembling poles 110, such that they are vertically parallel to each other by a predetermined distance corresponding to the standard width of a volleyball net.

As will be understood from the above description, by adjusting the distance and height of the assembling poles 110 and the number and length of the supporting bars 131, the multipurpose sectional sports apparatus 100 of the present invention can be used compatibly in a variety of sports games including Jokgu, handball, badminton, and the like.

Although the preferred embodiments of the present invention have been disclosed for illustrative purposes, those skilled in the art will appreciate that various modifications, additions and substitutions are possible, without departing from the scope and sprit of the invention as disclosed in the accompanying claims.

INDUSTRIAL APPLICABILITY

As apparent from the above description, a multipurpose sectional sports apparatus comprises: a plurality of assembling poles each including a pipe-shaped main pole and a sub pole, the main pole having a center insertion bore, an L-shaped lower fixture formed at a lower end of the main pole for balancing the main pole and a plurality of main coupling holes perforated in an upper portion of the main pole with a regular distance, the sub pole being configured to be inserted into the insertion bore of the main pole and having a plurality of height-adjusting holes perforated in a lower portion of the sub pole and a plurality of sub coupling holes perforated in an upper portion of the sub pole, the sub pole being movable up and down to adjust a height relative to the main pole as a fastener is fastened through a selected one of the height-adjusting holes of the sub pole and a corresponding one of the main coupling holes of the main pole; at least one connector including a branched body having a plurality of insertion branches radially protruding from the body with certain angles therebetween for connection of the plurality of assembling poles, each insertion branch having an opening serving as an entrance/exit of a corresponding one of the assembling poles and an insertion bore for receiving the assembling pole; and a supporting unit for supporting the assembling poles. With this configuration, the assembling poles can be assembled, in a simplified manner, with one another by the connector, to construct a variety of sports structures for use in a variety of ball games. By assembling the height-adjustable assembling poles by the connector that has the plurality of pole insertion branches radially protruded from the connector body by a variety of angles, the multipurpose sectional sports apparatus of the present invention can be used compatibly to construct a desired one of various shapes of sports apparatuses.

The invention claimed is:

1. A multipurpose sectional sports apparatus comprising:

a plurality of assembling poles each including a main pole and a sub pole, wherein the main pole has a center insertion bore, an L-shaped lower fixture formed at a lower end of the main pole for supporting the main pole and a plurality of main coupling holes perforated in an upper portion of the main pole so as to be vertically arranged in a line with a regular distance, the sub pole is configured to be inserted into the insertion bore of the main pole and has a plurality of height-adjusting holes perforated in a lower portion of the sub pole and a plurality of sub coupling holes perforated in an upper portion of the sub pole, and the sub pole is movable up and down to adjust a height relative to the main pole as a fastener is fastened through a selected one of the height-adjusting holes of the sub pole and a corresponding one of the main coupling holes of the main pole;

at least one connector including a branched body having a plurality of insertion branches radially protruding from the body with certain angles therebetween for connection of the plurality of assembling poles, each insertion branch having an opening serving as an entrance/exit of a corresponding one of the assembling poles and an insertion bore for receiving the assembling pole; and a supporting unit including a plurality of supporting bars for supporting the plurality of assembling poles when the assembling poles are connected to one another by the connector, at least one hollow supporting-connection member having a plurality of supporting-insertion branches for insertion of, supporting bars, the assembling pole or supporting bars selectively penetrating through the hollow supporting-connection member, and at least one branched connection member having a plurality of supporting-insertion branches for insertion of, supporting bars.

* * * * *